United States Patent [19]

Nitzberg et al.

[11] Patent Number: 4,986,321

[45] **Date of Patent: * Jan. 22, 1991**

[54] FUEL DISPENSING NOZZLE HAVING A FLOW RATE LIMITER

[76] Inventors: Leonard R. Nitzberg, P.O. Drawer 107, Knoxville, Tenn. 37919; Paul D. Manhardt, 1008 Tokalon Dr., Knoxville, Tenn. 37922

[ * ] Notice: The portion of the term of this patent subsequent to Jul. 4, 2006 has been disclaimed.

[21] Appl. No.: 385,796

[22] Filed: Jul. 27, 1989

Related U.S. Application Data

[63] Continuation-in-part of Ser. No. 21,399, Mar. 4, 1987.

[51] Int. Cl.[5] ..... B65B 3/00

[52] U.S. Cl. ..... 141/206; 141/392; 141/217; 222/547; 137/504

[58] Field of Search ..... 141/192, 198, 206–229, 141/392; 137/499, 504, 117; 239/571–572, 63; 251/16; 138/46; 222/547

[56] References Cited

U.S. PATENT DOCUMENTS 2,670,756 3/1954 Granberg ..... 137/499
4,124,037 11/1978 Siegwart ..... 137/499
4,825,916 5/1989 Fink, Jr. ..... 239/572
4,844,344 7/1989 Munhardt et el. ..... 222/547

*Primary Examiner*—Ernest G. Cusick
*Assistant Examiner*—Edward C. Donovan
*Attorney, Agent, or Firm*—Alan Ruderman

[57] ABSTRACT

A fuel dispensing nozzle for gasoline fuel pumping stations and the like has an inlet through which the fuel is supplied within a range of inlet pressures, an outlet from which fuel is discharged and a flow passage having valving for selectively opening communication between the inlet and the outlet in response to the pressure differential across the valving. The valving includes a housing within which a movable valve member is mounted, the valve member being actuated to open or partially close communication from an inlet of the housing to an outlet of the housing in response to the pressure differential across the valve member. As the pressure differential decreases above the pressure differential corresponding to the predetermined maximum rate, the valve member begins to close communication to prevent the flow from exceeding the predetermined maximum amount, and as the pressure differential increases communication is decreased so that the maximum predetermined flow rate is not exceeded.

9 Claims, 1 Drawing Sheet

FUEL DISPENSING NOZZLE HAVING A FLOW RATE LIMITER

REFERENCE TO RELATED APPLICATIONS

This application is a continuation-in-part of copending U.S. patent application Ser. No. 07/021,399, filed Mar. 4, 1987.

BACKGROUND OF THE INVENTION

This invention relates to fuel dispensing nozzles, and more particularly to apparatus for limiting the rate of flow of fuel through a fuel dispensing nozzle such that it is prevented from exceeding a preselected maximum flow rate.

Fuel dispensing nozzles are commonly used to dispense gasoline or other fuels into fuel tanks of motorized vehicles. Conventional dispensing nozzles include a nozzle body defining an internal flow passage extending between the nozzle inlet and its outlet. The inlet of the nozzle is connected to a supply hose which feeds pressurized gasoline or other fuel to the nozzle. This pressurized fuel passes through the internal flow passage to an outlet which consists of, or is connected to, a spout which serves as the discharge end of the nozzle. The spout is inserted into the neck of a motorized vehicle's fuel tank during filling operations. The pressurized fuel flow through the internal fuel passage is conventionally controlled by a valve which is actuated by a manually operated valve lever selectively depressed by the nozzle user during dispensing operations.

Fuel, under pressure created by a pump, is fed through the nozzle at flow rates established by the pump capacity and the extent to which the valve lever is actuated. It has been found that the rapid flow rates capable of being generated by conventional fuel pumps feeding the nozzle produce gasoline or other fuel fumes which escape into the atmosphere. Due to the wide spread use of dispensing nozzles and the volume of fumes escaping during dispensing operations, government regulations have been proposed which are designed to limit the rate of flow of fuel through the dispensing nozzle. By limiting the rate of flow, the amount of fumes escaping can be reduced to a level which is less likely to cause significant damage to the earth's atmosphere.

One of the problems in limiting the fuel flow through a fuel nozzle is that the fuel inlet pressure varies considerably at the various dispensing stations, e.g., the fuel inlet pressure may vary between approximately 8 psi and above 55 psi. If a small diameter nozzle outlet were utilized, and if a 10 gallon per minute level were to be established at 55 psi, then at an 8 psi station the flow through the nozzle would be too low from a practical standpoint. If the 10 gallon per minute flow limitation were established at 8 psi, then the flow rate would be excessive at a station pumping at 55 psi. Additionally, fuel dispensing nozzles include manually operable valving so that an operator ca control the amount of flow through the nozzle in a range from a small amount to the maximum amount that the nozzle can dispense. Thus, in limiting the maximum amount permitted to be dispensed through the nozzle the flow limiting device must take into consideration that when the manually controlled valving is only partially open, the flow limiting device should not retard flow until the predetermined maximum amount permitted is attained, and in those cases where the manually operable valving is opened to permit flow greater than that predetermined maximum amount, the flow limiting device should then take over and limit the fuel flowing through the nozzle to the predetermined maximum rate.

In our aforesaid copending application a fuel dispensing nozzle such as those at gasoline service stations and the like proposed a flow restriction device within the body of the nozzle, the device including a flow restricter which is mounted in the nozzle which is automatically operable for restricting the flow through the nozzle to a predetermined amount after the flow rate through the nozzle reaches that predetermined rate. When the rate of flow through the nozzle is less than the predetermined threshold flow rate, the restrictor is automatically operable to eliminate the restriction. The automatic operating means includes a helical blade member operatively associated with respective orifices, the blade member having reactive surfaces for moving a portion of the blade members to a position at least partially blocking the associated orifices to restrict the flow, and in another embodiment the flow restricting means has at least one orifice and includes means which define at least one reactive surface which when acted upon by the flow of fuel serves to slide a member to at least partially block the orifice to restrict the fuel flow. In other words, the flow restricting means is effected by the forces of the flowing fuel upon reactive surfaces causing a pressure differential proportional to the flow rate to move a restricter to partially block an orifice either by a sliding or a rotating action of a restricting device.

Thus, in our aforesaid patent application fuel flow is restricted by reducing the area through which the fuel can flow by means of the forces generated by the flowing fuel acting against reactive surfaces. It therefore requires restricters with sufficient reactive surface area to be established, and the correlation of such areas on elements having nonconventional geometric configurations may be difficult to attain.

SUMMARY OF THE INVENTION

Consequently, it is a primary object of the present invention to provide a liquid fuel dispensing nozzle having fuel flow rate limiting apparatus within the body of the nozzle, the flow rate limiting apparatus having flow actuated valving means automatically operable in response to a pressure differential across the valving means to preclude the flow through the nozzle from exceeding a predetermined rate.

It is another object of the present invention to provide a liquid fuel dispensing nozzle having fuel flow rate limiting apparatus within the body of the nozzle, the flow rate limiting apparatus having flow actuated valving means, the valving means having a valve member actuated to control flow through the valving means in relation to the pressure differential across the valving means.

Accordingly, the present invention provides a fuel dispensing nozzle for dispensing gasoline at fuel pumping stations and the like, the nozzle having an inlet through which the fuel is supplied within the range of supply inlet pressures encountered at such stations, and an outlet from which the fuel is discharged. The nozzle includes a flow passage having manually operable valving for selectively opening communication between the inlet and the outlet of the nozzle. Flow actuated valving means is disposed in the flow passage between the nozzle inlet and outlet, the flow actuated valving means being automatically operable in response to the pressure differential across the valving means. The valving means includes a movable valve member actuated to open or partially close communication from a valve inlet port to a valve outlet port in response to the pressure differential. As the pressure differential increases, the valve member chokes down the communication through the valving means to prevent the flow from exceeding the predetermined maximum amount, but is inoperative until the maximum rate is reached. Thus, the manually operable valving opens communication between the inlet and the outlet of the nozzle and controls the flow therethrough until the predetermined rate is reached, and thereafter the flow actuated valving limits the flow through the nozzle.

In one form of the invention the valve member is biased into a position wherein the inlet and outlet ports of the flow actuated valving communicate fully with each other and thereafter subsequent to the predetermined maximum flow rate being attained, the valve member is moved to overcome the bias to partially block or restrict the communication. As the manually operable valving is opened further the flow actuated valve member is automatically moved against the urging of the biasing means to further block communication between the flow actuated valving ports. In this form of the invention the valve member may slide or rotate against the biasing force of the spring or the like and includes respective surfaces acted upon by both the upstream and downstream pressure, the pressure differential resulting in respective forces acting against the biasing force of the spring.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
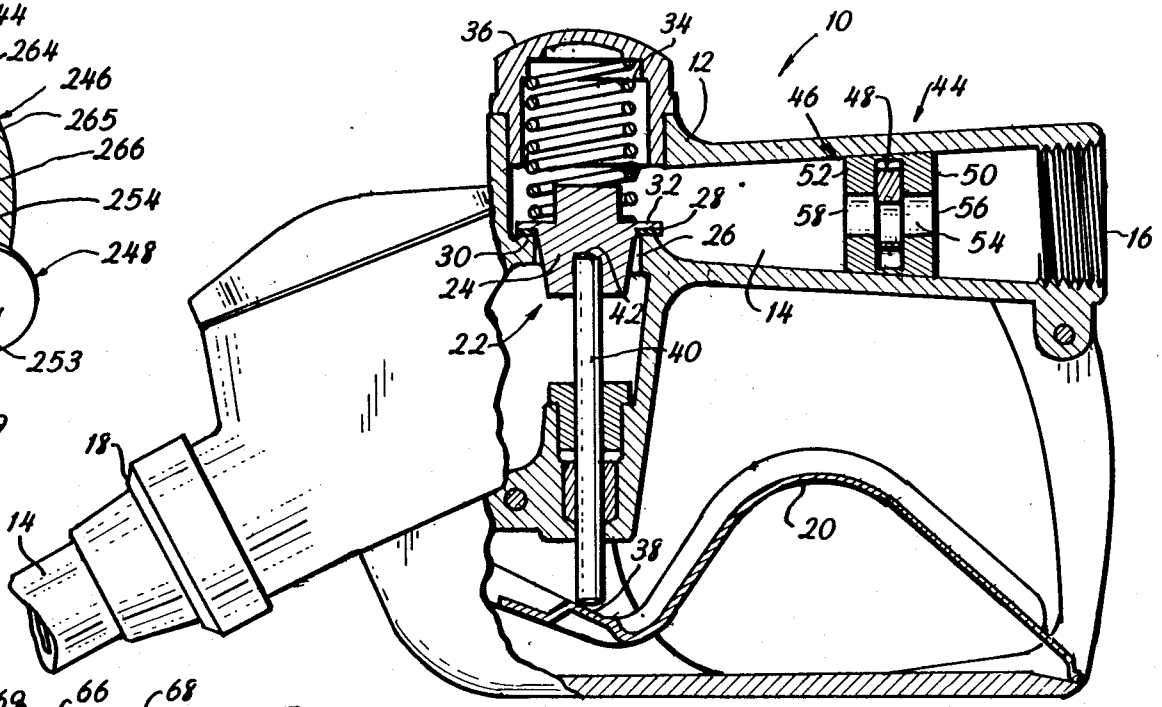
FIG. 1 is a fragmentary elevational view partly in cross section of a fuel dispensing nozzle including apparatus constructed in accordance with one embodiment of the present invention.

Referring to the drawings, FIG. 1 illustrates a preferred form of the invention in conjunction with a fuel dispensing nozzle 10 having a body portion 12 within which a flow passage 14 is formed, the passage 14 receiving fuel from an inlet 16 under pressure supplied by pumping means (not illustrated) at the fuel dispensing station and directing it to an outlet 18 which conventionally comprises or may be connected to a discharge spout 19 for insertion into the neck of an automobile fuel receiving tank (not illustrated). A trigger lever 20 conventionally is pivotably connected for manual operation of valving 22. The valving 22 conventionally comprises a tapered valve member 24 receivable within a passage in a valve chamber 26 formed in the passage 14 and normally urged to close the chamber and shut communication of the fuel from the inlet 16 to the outlet 18. An annular sealing ring 28 is positioned on a seat 30 which receives an annular shoulder 32 formed on the valve member when the valve member is in the closed position. A coil spring 34 acts against the shoulder 32 and a cap 36 connected to the body 12 above the passageway for closing the valve chamber, the spring acting to urge the valve member 24 into closing relationship with the passageway to shut flow communication between the inlet 16 and the outlet 18 until the trigger 20 is squeezed. The trigger 20 includes a detent 38 within which an actuating rod 40 is received, the rod extending into the fuel passage and being received within a recess 42 in the valve member 24. Thus, when the trigger 20 is squeezed the valve member 24 is forced out of closing relationship with the fuel passage against the urging of the spring 34, the passageway being opened in proportion to the movement of the trigger and, conventionally, the amount of fuel flowing being dependent upon the amount the passageway is opened.

In accordance with the present invention flow actuated valving means 44 is disposed in the passageway 14. The particular location of the valving means 44 is not critical to the present invention. Thus, it may be placed upstream or downstream of the manual valving 22, and is illustrated for descriptive purposes as being upstream of the manual valving 22. The flow actuated valving means 44 includes a housing 46 disposed within the passageway 14, the housing 46 having a valve member 48 positioned therein and movable relative to the housing. The housing 46 may be formed integral with the nozzle body 12, or may be formed separate therefrom so as to be a retrofit item to be assembled into existing conventional nozzles. Additionally, the housing 46 may be constructed as a single body member having an opening between two walls 50, 52 for receiving the valve member 48, or may be constructed as two separate elements forming the upstream and downstream wall members 50, 52 respectively. In either case, the housing 46 includes a flow passage 54 extending through the wall members 50 and 52 so that the fuel may flow therethrough from an inlet port 56 upstream of the valve member 48 through an outlet port 58 downstream of the valve member 48.

Figure 2:
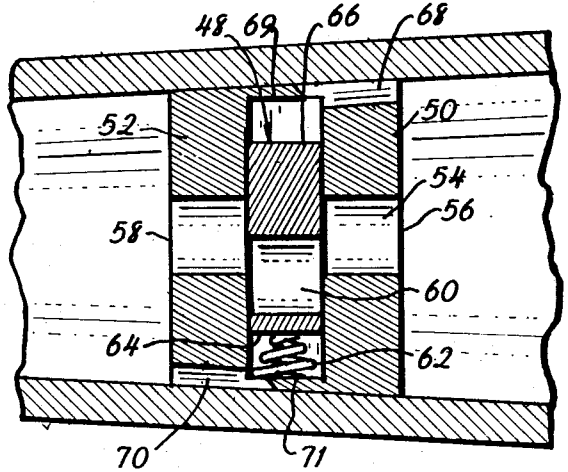
FIG. 2 is a fragmentary cross sectional view of the flow actuated valving means incorporated in the nozzle illustrated in FIG. 1 greatly magnified in size.

The valve member 48 may be any convenient movable member for moving between an open position permitting fuel to flow unrestricted through the passageway 54 to a position wherein the valve member obstructs the flow through the passageway 54 and limits the flow therethrough to the predetermined maximum rate. As best illustrated in FIG. 2, in the first preferred embodiment of the present invention, the valve member 48 comprises a slidable element similar to a gate valve having an opening 60 extending therethrough adapted to register with the flow passage 54 in the walls 50 and 52 of the housing 46 so as to permit flow to flow therethrough without obstruction. The valve member 48 may be urged into this open position by the biasing force of a spring 62 acting between a portion of the housing 46 or the wall of the body 12 forming the passageway 14 in the vicinity of the flow actuated valving means and an adjacent surface 64 of the valve member 48. The spring 62 may be of any conventional type for urging the valve member 48 to the position where the opening 60 is aligned with the passageway 54, such as a coil type tension spring as illustrated. So that the position of the valve member 48 is not affected by gravity, buoyancy or the attitude in which the nozzle 10 is disposed, and therefore does not contribute to the opening or closing of the passage 54, it is desirable that the valve member 48 be constructed from a material having a similar specific gravity as that of the fuel being dispensed, or the valve member 48 may be constructed in a honeycomb fashion with internal voids.

Because of the restriction provided by the flow passage 54 a pressure differential results across the housing 46. As the flow of liquid through the passage 54 increases, the pressure differential also increases so that the upstream facing surface of the wall 50 is proportionately greater than the downstream facing surface of the wall 52. Effectively, the housing 46 acts a an orifice plate creating larger pressure differentials between the upstream and downstream surfaces as the flow through the nozzle is increased by squeezing the trigger 20 to further open the manually operable valving 22.

Formed in the wall 50 at a disposition spaced from the inlet port 56 and from a surface 66 on the valve member 48 when the valve member is in the fully opened position, is a high pressure passageway 68 extending through the housing wall 50 from the upstream side into the space between the walls 50 and 52. To ensure that the surface 66 is exposed to the upstream fuel pressure when the valve member 48 is in the fully open position, the housing may include a convex surface 69. The edges of the convex surface 69 act as a stop or seat for the valve member when in the open position. A similar passageway 70 is formed in the housing wall 52 opening from the downstream facing surface thereof to a position intermediate the walls 50 and 52, the portal 70 in the embodiment illustrated in FIG. 2 opening in the vicinity of the spring 62 so that the lower downstream pressure communicates to the surface 64 of valve member 48. Again the convex surface 71 or some other similar means such as a ledge or protrusion ensures that the downstream pressure acts on the surface 64, and may additionally provide a seat for the spring 62. Thus, the higher upstream pressure acts on the surface 66 of the valve member 48 while the lower downstream pressure acts on the surface 64 of the valve member. Accordingly, a pressure differential exists across the valve member 48 which is in opposition to the biasing force of the spring 62. When the rate of fuel flow through the nozzle is less than the predetermined maximum, e.g., 10 gallons per minute, the spring force is greater than the force on the valve member due to the pressure differential between the surfaces 66 and 64, and the valve member remains in the open position. However, as the rate of fuel flowing through the nozzle increases the differential pressure acting on the valve member overcomes the threshold resistance of the spring 62 to move the valve member resulting in the opening 60 being offset from the passage 54, i.e., the body of the valve member 48 restricts the flow of fuel through the passage 54 so as to limit the flow therethrough. The greater the pressure differential on the valve member 48 due to the pressures acting on the surfaces 64 and 66, the greater the restriction provided by the valve member 48 until the valve member 48 attains a position wherein the flow area of the passageway 54 is restricted to a minimum area which precludes any additional flow beyond the predetermined amount from passing therethrough independent of the amount the manual valve 22 is opened.

Figure 3:
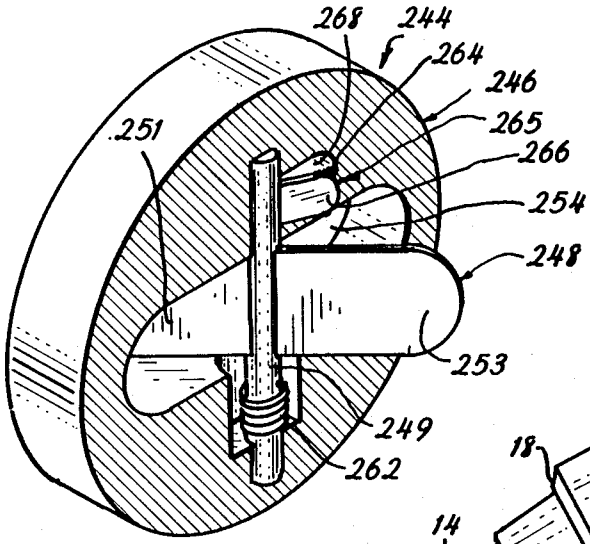
FIG. 3 is a fragmentary perspective view partly broken away of a second embodiment of a flow actuated valving means in accordance with the present invention, disassembled from the nozzle.

In an alternate embodiment to that illustrated in FIG. 2, rather than a sliding gate valve member, the valving 244 may utilize a butterfly valve member 248 as illustrated in FIG. 3. Here, the housing 246, which is illustrated as partially broken away for clarity of presentation, rotatably carries a journal member in the form of a mounting pin 249 to which the butterfly valve member 248 is secured with each half of the plates 251, 253 forming the butterfly member 248 extending from the pin 249 in diametrically opposed relationship to the other, the pin 249 forming the pivot axis of the valve member. The valve member may be positioned so that it is fully open to permit fuel to flow unrestricted through the valve passage 254 which is substantially of the same cross sectional configuration as the valve member when in the closed position, or the valve may be positioned so that the passage 254 is obstructed to restrict the flow of fuel to the predetermined maximum rate. The valve member 248 may be urged to the open position by the biasing force of a torsion spring 262 attached at one end to the housing 246 and at the other end to the pin 249 so that the pin and thus the valve member 248 may be biased about the axis of the pin toward the fully opened position. So that the position of the valve member 48 is not effected by gravity, buoyancy or the attitude in which the nozzle 10 is disposed, and therefore does not contribute to the opening or closing of the passage 254, the weight and area of the plate members 251 and 253 are substantially equal and balanced about the axis of the pin 249.

Fastened to the pin 249 adjacent the butterfly valve 248 is a control plate 265 which has a high pressure surface 266 and a low pressure surface 264 and which is disposed within a passageway 268 spaced from the passage 254 and opening onto both the upstream and downstream surface of the housing 246 and thus the upstream and downstream portions of the flow passage 14. The plate 265 is positioned to substantially close the passageway 268 when the butterfly valve 248 is in the fully opened position. Thus, high upstream pressure acts on the surface 266 while lower downstream pressure acts on the surface 264 when fuel is flowing. Accordingly, a pressure differential exists across the surfaces 264, 266 which is in opposition to the biasing force of the spring 262. When the rate of fuel flow through the nozzle is less than the predetermined maximum, e.g., 10 gallons per minute, the spring force is greater than the force on the plate 265 due to the pressure differential between the surfaces 266 and 264, and the valve remains in the open position. However, as the rate of fuel flowing through the nozzle increases the differential pressure acting on the plate 265 overcomes the threshold resistance of the spring 262 to move the butterfly valve member resulting in a partial obstruction of the passage 254 to restrict the flow of fuel therethrough. The greater the pressure differential on the plate member 265 due to the pressures acting on the surfaces 264 and 266 the greater the restriction provided by the valve member 248 until the valve member 248 attains a position wherein the flow area of the passage 254 is restricted to a minimum area which precludes any additional flow beyond the predetermined amount from passing therethrough independent of the amount the manual valve 22 is opened.

Accordingly, the present invention provides flow limiting apparatus within a liquid fuel dispensing nozzle, the flow limiting apparatus having valving actuated to control flow through the nozzle in relation to the pressure differential across the valving, and the rate of flow through the nozzle is independent of the amount that the manually operable nozzle valve is opened once the predetermined maximum amount of fuel flowing through the nozzle is attained.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A fuel dispensing nozzle having an inlet through which liquid fuel is supplied, to said nozzle under pressure, an outlet means adapted to discharge fuel into a fuel tank of a vehicle, an internal flow passage along which said fuel flows from said inlet to said outlet, manually operable valve means disposed within said passage intermediate said inlet and said outlet for selectively opening communication between said inlet and said outlet to permit fuel to flow from said inlet to said outlet, and fuel rate limiting means for limiting the volumetric rate of fuel flowing through said nozzle to a predetermined maximum rate independent of the fuel inlet pressure and independent of the amount of communication provided between said inlet and said outlet by said valve means, said fuel rate limiting means comprising housing means disposed in said flow passage, said housing means having a passageway for ingress and egress of fuel and for providing a pressure differential across said housing when fuel is flowing, a valve movably mounted in said housing for movement in response to the pressure differential across said housing between a first position which opens said passageway and other positions which partially obstruct said passageway and limit the fuel flowing therethrough to said predetermined maximum rate, said valve including a first surface exposed to the higher pressure upstream of said housing and a second surface exposed to the lower pressure downstream of said housing, said first and second surfaces being disposed relatively to one another for providing opposing forces on said valve for moving said valve between said first position and said other positions in response to said pressure differential, and biasing means for maintaining said valve in said first position when said manually operable valve initially opens communication between said inlet and said outlet and until said predetermined maximum flow rate is attained, whereupon a threshold differential results across said housing to move said valve from said first position to said other positions to limit the rate of fuel flow to said predetermined maximum amount.

2. A fuel dispensing nozzle as recited in claim 1, wherein said valve is mounted for slidably moving relatively to said passageway.

3. A fuel dispensing nozzle as recited in claim 2, wherein said housing includes a first bleed port communicating said passage upstream of said housing with said first surface, and a second bleed port communicating said passage downstream of said housing with said second surface, whereby said first surface is exposed to pressure upstream of said housing and said second surface is exposed to pressure downstream of said housing.

4. A fuel dispensing nozzle as recited in claim 3 wherein said biasing means comprises spring means for applying a force on said second surface in aid of the force applied by said downstream pressure.

5. A fuel dispensing nozzle as recited in claim 4 wherein said valve comprises a plate member having a bore extending therethrough, said bore being in full communication with said passageway when said valve is in said first position, and said valve is movable in a direction to obstruct said flow communication.

6. A fuel dispensing nozzle as recited in claim 5 including first and second cavities respectively defined between said first and second surfaces of said plate and said internal flow passage, said first and second bleed ports respectively communicating with said first and second cavities.

7. A fuel dispensing nozzle as recited in claim 1, wherein said valve includes a mounting pin, means for journally mounting said pin in said housing for rotation about an axis, said valve further including first and second plates disposed in said passageway fastened to said pin and extending in diametrically opposed directions relative to said axis, said housing having a bleed port extending therethrough, and a third plate spaced from said first and second plates extending from said pin and disposed in said bleed port, said first and second surfaces being opposed surfaces of said third plate, said third plate closing said bleed port when said first and second plates are disposed in said first position and partially closing said bleed port when said first and second plates are disposed in said other positions.

8. A fuel dispensing nozzle as recited in claim 1 wherein said valve is mounted for rotation relative to said passageway.

9. A fuel dispensing nozzle having an inlet through which liquid fuel is supplied to a nozzle under pressure, an outlet from which fuel is discharged as into a fuel tank of a vehicle, an internal flow passage along which said fuel flows from said inlet to said outlet, manually operable valve means disposed within said passage intermediate said inlet and said outlet for selectively opening communication between said inlet and said outlet to permit fuel to flow from said inlet to said outlet, and fuel rate limiting means for limiting the volumetric rate of fuel flowing through said nozzle to a predetermined maximum rate independent of the fuel inlet pressure and independent of the amount of communication provided between said inlet and said outlet by said valve means, said fuel rate limiting means comprising housing means disposed in said flow passage, said housing means having a passageway for ingress and egress of fuel and for providing a pressure differential across said housing when fuel is flowing, a butterfly valve rotatably mounted in said housing for movement in response to the pressure differential across said housing between a first position which opens said passageway and other positions which partially obstruct said passageway and limit the fuel flowing therethrough to said predetermined maximum rate, a port formed in said housing spaced from said passageway and communicating said passage downstream of said housing with said passage upstream of said housing, said butterfly valve including plate means disposed in said port, said plate means having first and second surfaces respectively exposed to the higher pressure upstream of said housing and the lower pressure downstream of said housing for providing a rotational moment on said valve in response to the pressure differential across said surfaces, and biasing means for providing a moment on said valve in opposition to said plate means.

* * * * *